US007398576B2

(12) United States Patent
Horian

(10) Patent No.: US 7,398,576 B2
(45) **Date of Patent: *Jul. 15, 2008**

(54) SPONGE MOP AND SCRUBBER

(76) Inventor: James G. Horian, 14 Sidra Cove, Newport Beach, CA (US) 92657

( * ) Notice: Subject to any disclaimer, the term of this patent is extended or adjusted under 35 U.S.C. 154(b) by 0 days.

This patent is subject to a terminal disclaimer.

(21) Appl. No.: 11/621,055

(22) Filed: Jan. 8, 2007

(65) Prior Publication Data

US 2007/0169291 A1 Jul. 26, 2007

Related U.S. Application Data

(63) Continuation-in-part of application No. 11/016,667, filed on Dec. 17, 2004.

(51) Int. Cl.
*A47L 13/12* (2006.01)
*A47L 13/144* (2006.01)

(52) U.S. Cl. ..... 15/116.2; 15/119.2

(58) Field of Classification Search ..... 15/116.1, 15/116.2, 119.1, 119.2
See application file for complete search history.

(56) References Cited

U.S. PATENT DOCUMENTS 4,491,998 A 1/1985 Wilson et al.
4,604,767 A * 8/1986 Burkhart et al. ..... 15/119.2
4,654,920 A * 4/1987 O'Neil et al. ..... 15/119.2
4,908,901 A 3/1990 Torres
5,097,561 A * 3/1992 Torres ..... 15/119.2
5,331,706 A 7/1994 Graham
5,655,248 A * 8/1997 Kieson et al. ..... 15/119.2
6,026,530 A * 2/2000 Camp, Jr. ..... 15/119.2
6,305,042 B1 * 10/2001 Lalli ..... 15/119.2
6,341,401 B1 * 1/2002 Lin ..... 15/119.2
6,490,749 B1 12/2002 Morad
6,643,885 B2 11/2003 Morad et al.
6,865,768 B2 * 3/2005 Chen ..... 15/115

* cited by examiner

*Primary Examiner*—Mark Spisich
(74) *Attorney, Agent, or Firm*—Stetina Brunda Garred & Brucker

(57) ABSTRACT

A mop has a shaft, a housing at a distal end of the shaft, a sponge movably coupled to the housing, and a pair of rollers. The pair of rollers are movably mounted to the housing spaced apart from each other and straddle at least a portion of the sponge. The mop also comprises an actuator configure to move the sponge between the rollers from a retracted position to a deployed position. At least one scrubbing element is disposed on at least one of the rollers, the scrubbing element configured to automatically move into a deployed position as the sponge is moved into the retracted position, the scrubbing element also configured to automatically move into a retracted position as the sponge is moved into the deployed position.

10 Claims, 10 Drawing Sheets

SPONGE MOP AND SCRUBBER

CROSS-REFERENCE TO RELATED APPLICATIONS

This application is a continuation-in-part application of U.S. application Ser. No. 11/016,667, filed Dec. 17, 2004, the entire contents of which are hereby incorporated by reference and should be considered a part of this specification.

BACKGROUND OF THE INVENTION

1. Field of the Invention

The present invention relates generally to the field of sponge mops and more particularly to a sponge mop having an integrated scrubber.

2. Description of the Related Art

Conventional roller mops use a sponge that is wrung dry between a pair of rollers. Such roller mops use a lever that can be pulled or pushed, causing the rollers to roll or press the sponge, wringing the sponge out. Some conventional mops include a brush scrubber that a user can manually attach to the sponge, the mop head, or the mop handle. With such mops, the user must detach the scrubber from the mop when done scrubbing the surface. Additionally, such mops are quite cumbersome and require that the user rotate the entire mop upside down or on its side to use the brush scrubber to scrub a surface.

SUMMARY OF THE INVENTION

In one aspect of the present invention, a combination sponge mop and scrubber for cleaning a surface is provided. The sponge mop and scrubber comprises a housing and a pair of rollers mounted on the housing on each side of a sponge. At least one of the pair of rollers supports a scrubber brush. The rollers are configured to squeeze the sponge when the sponge is retracted into the housing. The rollers are automatically rotated via a frictional engagement with the sponge to move the scrubber brush into a deployed position to scrub the cleaning surface as the sponge is retracted. At least one locking member is attached to at least one of the pair of rollers, the locking member configured to engage the housing when the sponge is retracted between the rollers and the scrubber brush is in the deployed position, so as to limit the rotation of the rollers, wherein said scrubber brush is automatically deployed whenever the sponge is squeezed to discharge liquid therefrom.

In another aspect of the present invention, a combination sponge mop and scrubber brush is provided, wherein said scrubber brush is automatically deployed whenever the sponge is squeezed to discharge liquid therefrom. The sponge mop and scrubber comprises a housing and a pair of rollers mounted on the housing on each side of a sponge. Each of the pair of rollers supports a scrubber brush, the rollers configured to both squeeze the sponge when the sponge is retracted into the housing. The rollers automatically rotate to move the scrubber brush into a deployed position as the sponge is moved into a retracted position.

In still another aspect of the present invention, a mop for cleaning a surface is provided. The mop comprises a shaft, a housing disposed at a distal end of the shaft, a sponge movably coupled to the housing, and a pair of rollers movably mounted to the housing, the rollers spaced apart from one another and straddling at least a portion of the sponge. The mop also comprises an actuator configured to move the sponge into a retracted position between the rollers, wherein the rollers squeeze the sponge to wring liquid from the sponge, and at least one scrubbing element disposed on at least one of the rollers. The at least one scrubbing element is configured to automatically move into a deployed position as the sponge is retracted, and configured to automatically move into a retracted position when the sponge is moved into a deployed position.

DETAILED DESCRIPTION OF THE PREFERRED EMBODIMENTS

As used herein, a roller refers generally to a member having a movable surface and is not limited to a particular shape or configuration. A roller can thus include a member with a circular, oval, c-shaped, u-shaped or generally curved cross-section. In one embodiment, the movable surface can rotate about an axis. In another embodiment, the movable surface can pivot about an axis.

Figure 1:
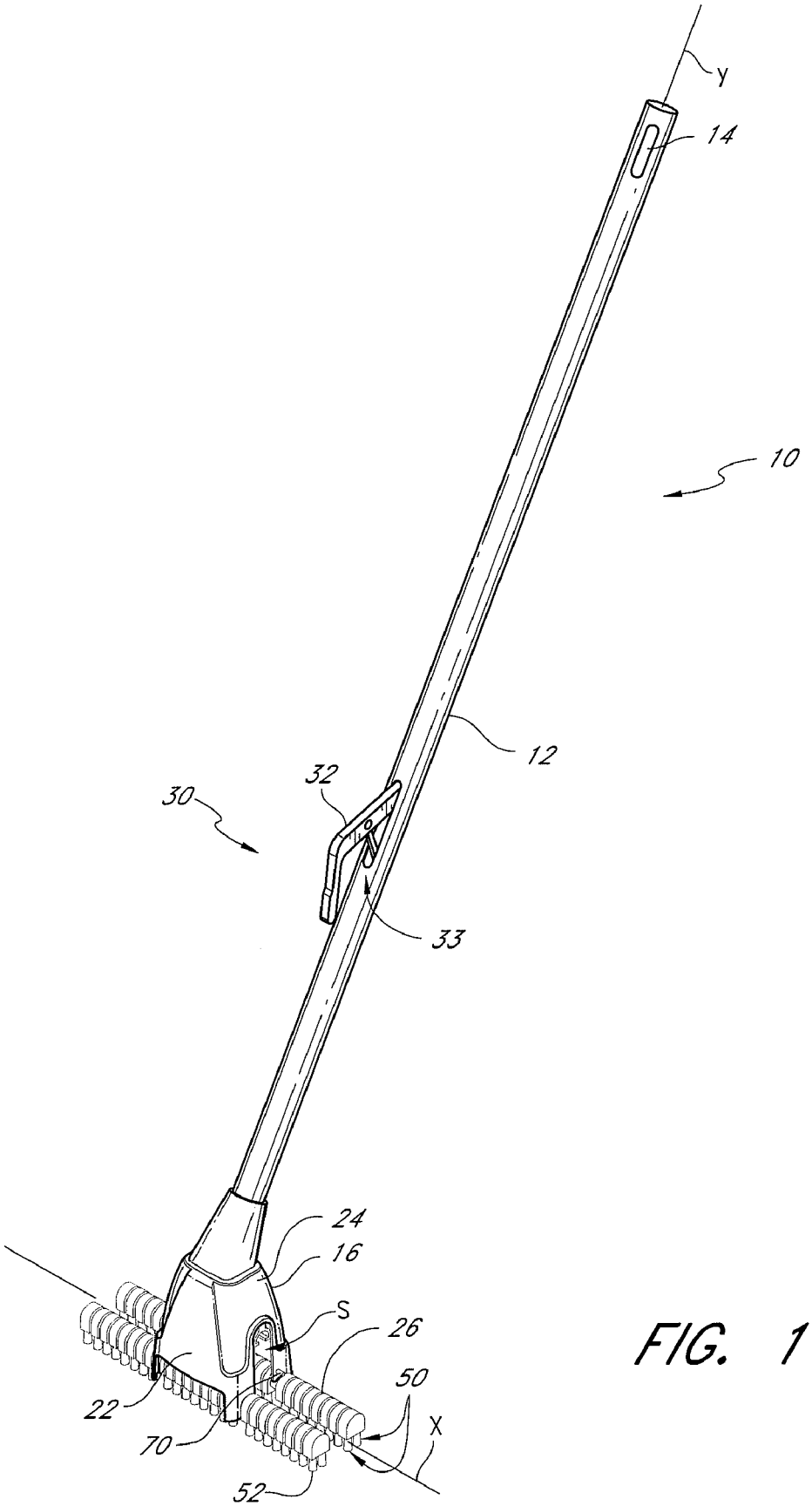
FIG. 1 is a perspective schematic view of one embodiment of the cleaning device.
Figure 2:
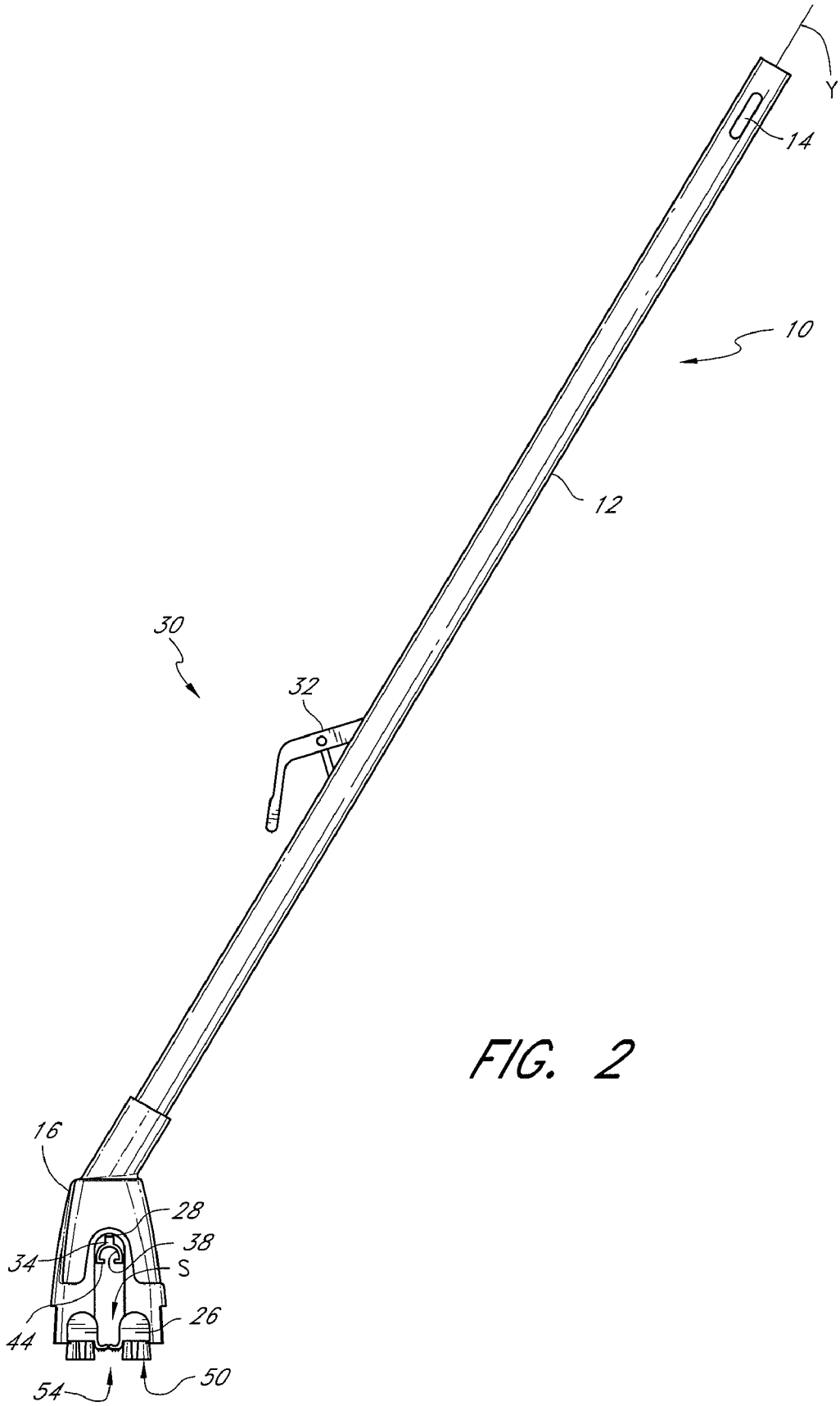
FIG. 2 is a schematic side view of the cleaning device shown in FIG. 1.

With reference to FIGS. 1 and 2, a cleaning device 10 or mop is illustrated therein. The mop 10 includes an elongated handle or shaft 12 extending along an axis Y, a slot 14 at a proximal end of the shaft 12, and a body or housing 16 at a distal end of the shaft 12. In the illustrated embodiment, the housing 16 includes front and rear walls 22 and side walls 24. The side walls 24 are advantageously spaced apart and define a slot S therebetween.

The rollers 26 are preferably fastened to the distal end of the housing 16. In one preferred embodiment, the rollers 26 are removably fastened to the housing 16 so as to be readily and easily replaceable. For example, a roller shaft (not shown) of the rollers 26 can be removably clamped to a c-shaped clamp (not shown) on the housing 16. However, other suitable fasteners can be used to fasten the rollers 26 to the housing 16, such as bolts and screws.

In the embodiment illustrated in FIGS. 1 and 2, the rollers 26 have a generally U-shaped cross-section. However, the rollers 26 can have other suitable cross-sections, such as circular, oval, or curved. The rollers 26 preferably comprise a movable surface 26*a* (see FIG. 3) and include a scrubbing element disposed on the movable surface 26*a*, as discussed further below. In one embodiment, the rollers 26 rotate about an axis generally perpendicular to the elongated shaft 12. In the illustrated embodiment, said axes extend generally parallel to an axis X that extends through the slot S.

The elongated shaft 12, housing 16, and rollers 26 are preferably made of a resilient and light-weight material, such as a hard plastic. For example, they can be made of polyethylene. However, the elongated shaft 12, housing 16, and rollers 26 can be made of other suitable materials.

As shown in FIGS. 1 and 2, the mop 10 also includes an actuator or deployment mechanism 30. The actuator 30 includes an operating member 32 pivotably fastened through a slot 33 to the shaft 12 and to an operating rod 28 (see FIG. 3) that extends longitudinally through at least a portion of the length of the shaft 12. In the illustrated embodiment, the operating member 32 is a lever that is pivoted up or down relative to the shaft 12. However, the actuator 30 and operating member 32 can be other suitable mechanisms, such as a knob that is pulled in and out of the shaft 12, for operating the mop 10.

In the illustrated embodiment, a sponge retainer 34 having opposite side walls 38 is preferably fastened to a distal end of the operating rod 28. Guide rails 44 extend from a distal end of the side walls 38. The sponge retainer 34 preferably has a length that extends longitudinally along the axis X generally orthogonal to the axis Y. The sponge retainer 34 is preferably configured to removably hold a sponge 40 therein (see FIG. 3). In one preferred embodiment, the sponge 40 has a brace member 42 that is slidably inserted into the sponge retainer 34. Such a sponge 40 for use in combination with the embodiments of a sponge mop described herein is further described in U.S. Pat. No. 6,643,885, the contents of which are hereby incorporated in their entirety and should be considered a part of this specification.

Figure 3:
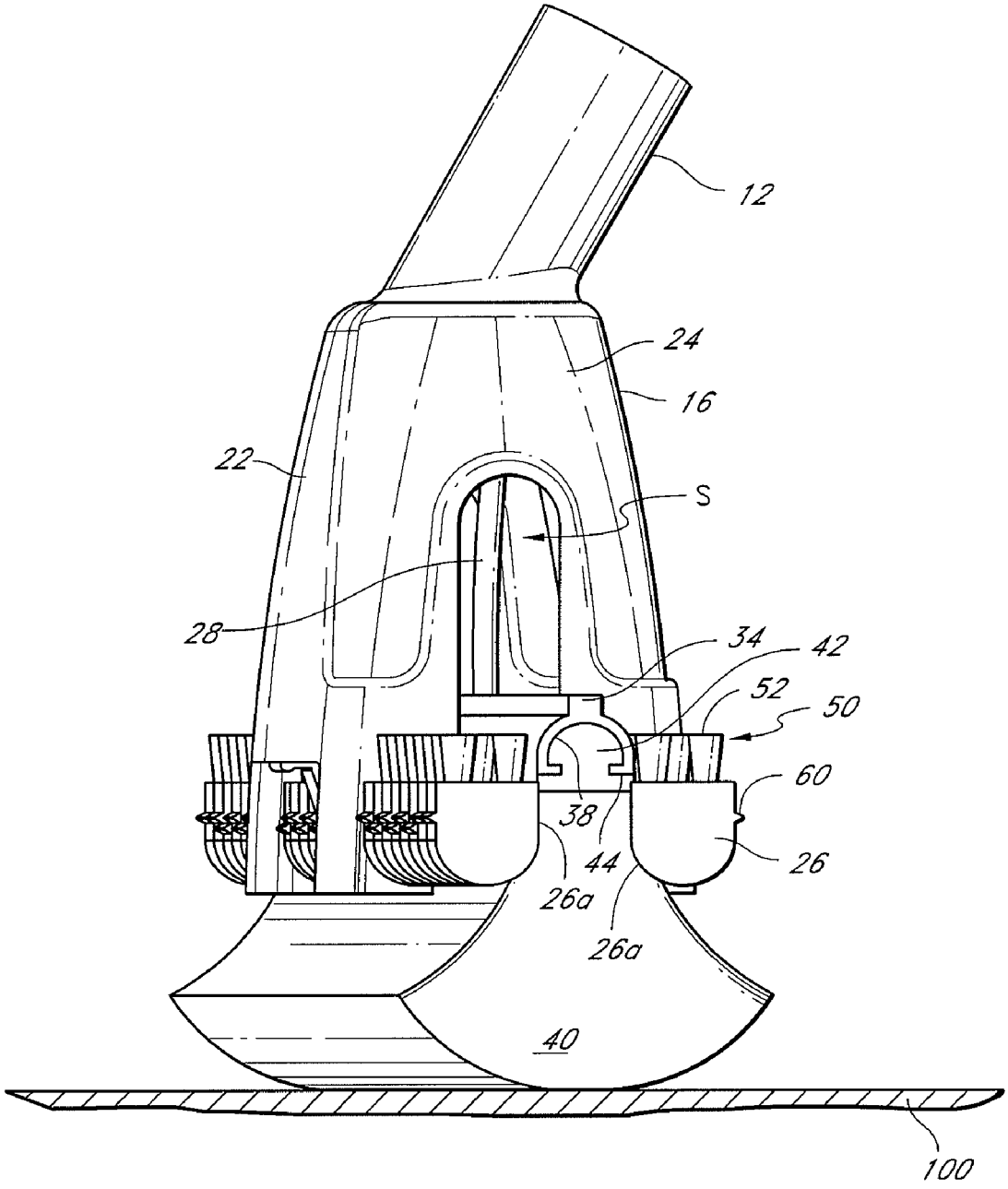
FIG. 3 is a schematic partial perspective view of one embodiment of the cleaning device in a first operating position.
Figure 4:
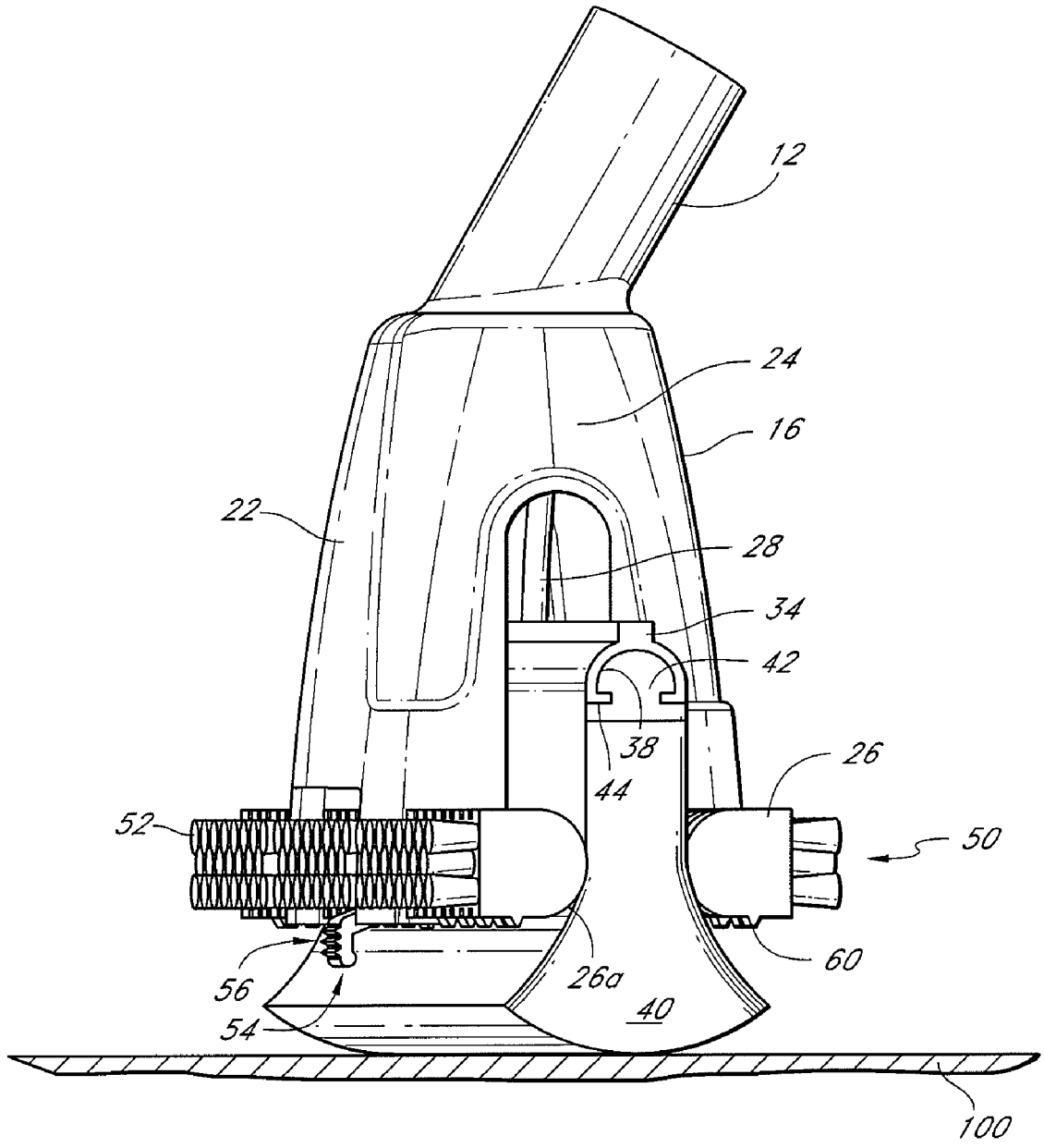
FIG. 4 is a schematic partial perspective view of the cleaning device shown in FIG. 3, in a second operating position.
Figure 5:
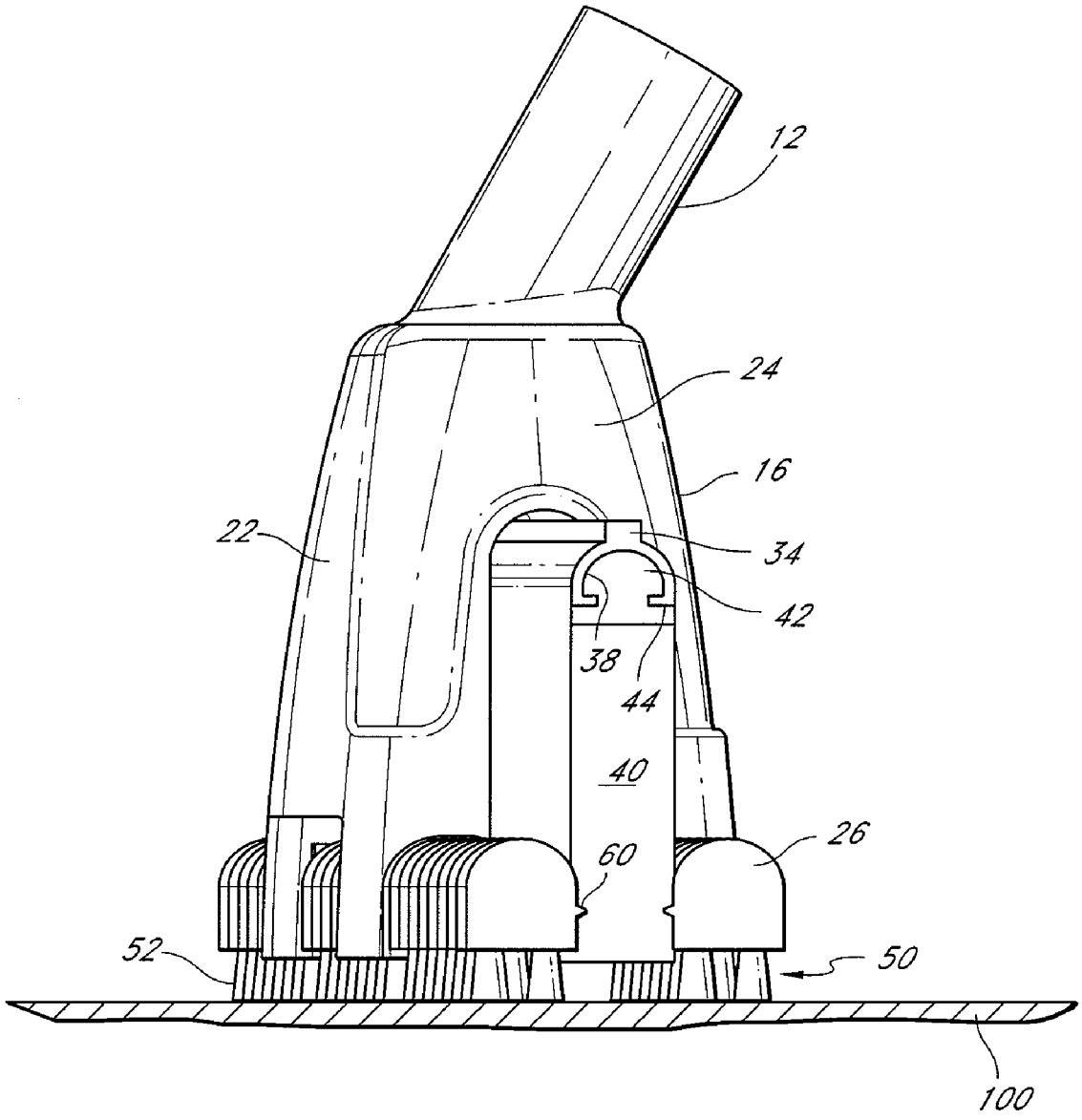
FIG. 5 is a schematic partial perspective view of the cleaning device shown in FIG. 3, in a third operating position.

As discussed above, the rollers 26 preferably have a movable surface 26*a* and at least one scrubbing element disposed thereon. As illustrated in FIGS. 3-5, in one embodiment, the movable surface 26*a* is curvilinear and the at least one scrubbing element is a scrubber brush 50 disposed on a portion of the movable surface 26*a*, wherein the brush 50 has a plurality of bristles 52. In the illustrated embodiments, a plurality of scrubber brushes 50 are disposed along substantially the entire length of the rollers 26. In another embodiment, the brushes 50 can be disposed along a portion of the length of the rollers 26, such as on either side of the housing 16. Additionally, in the illustrated embodiment, one of the at least one scrubbing elements is a scraper 54 (see FIG. 4). The scraper 54 preferably has serrated members 56 configured to scour a cleaning surface 100, as discussed below. In a preferred embodiment, the serrated members 56 are made of a non-scratching poly resin configured to remove tough marks or stains on the cleaning surface 100 without scratching the cleaning surface 100. However, the scraper 54 can be made of other materials suitable for scouring the cleaning surface 100 without scratching the surface 100.

Figure 6:
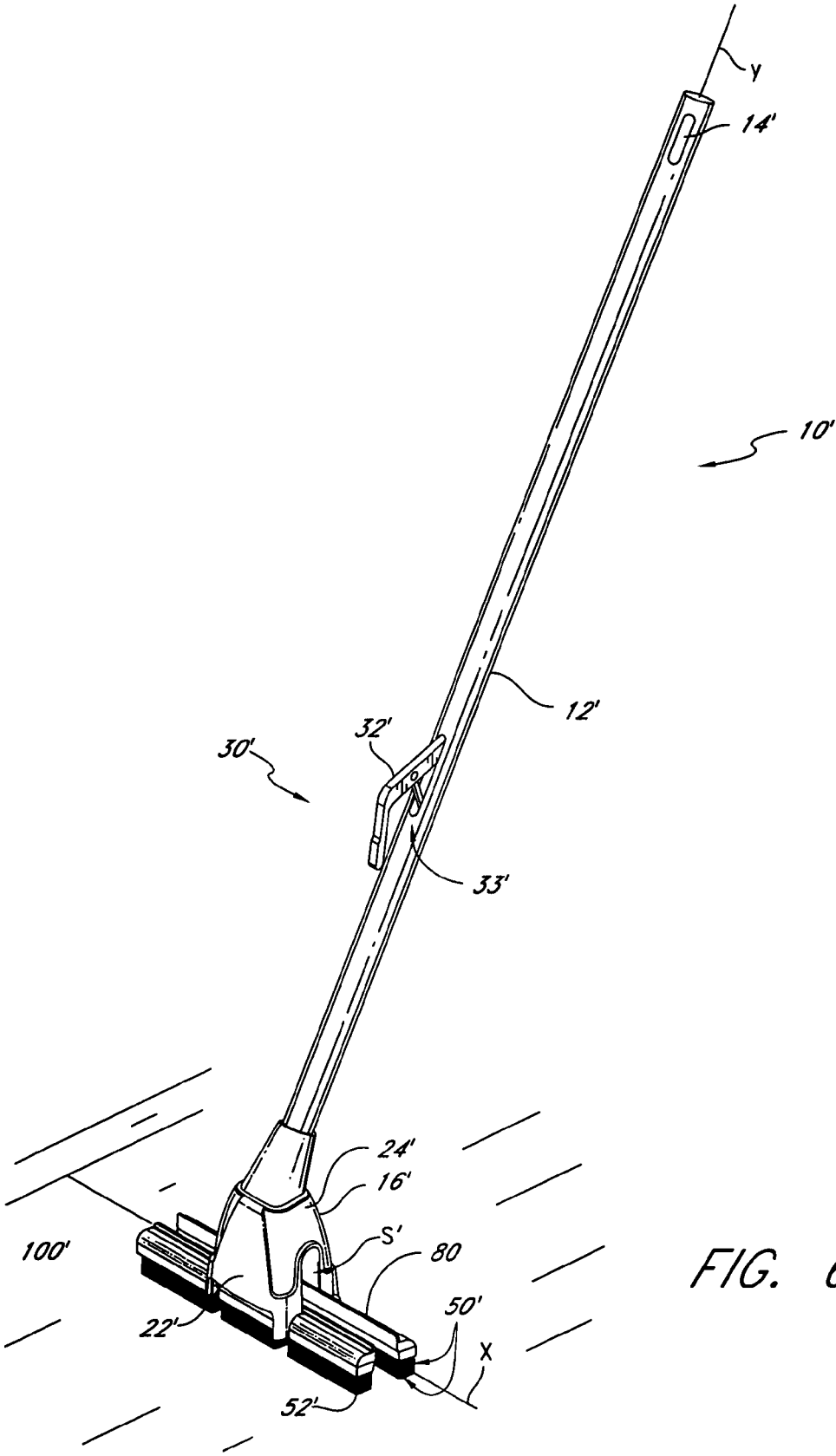
FIG. 6 is a schematic perspective view of another embodiment of the cleaning device.

With continued reference to FIGS. 3-5, each of the rollers 26 preferably comprises at least one locking member 60 disposed on the movable surface 26*a*. In the illustrated embodiment, a plurality of locking members 60 are shown. However, in other embodiments, the rollers 26 can have any suitable number of locking members 60. In the illustrated embodiment, the locking members 60 are spike-shaped tabs. However, the locking members 60 can have other suitable shapes. The locking members 60 advantageously engage at least a portion of the sponge 40 when the sponge is in a retracted position and the scrubbing elements are in a deployed position, as discussed further below and as shown in FIG. 6. For example, the locking members 60 can grip a surface of the sponge 40. Preferably, the locking members 60 substantially hold the sponge in a generally fixed position relative to the rollers 26 while the locking members 60 are engaged to the sponge 40 and the scrubbing elements are deployed. In the illustrated embodiment, the locking members 60 are staggered relative to each other and disposed at an angle of about 90 degrees relative to the brushes 50. However, other suitable arrangements can be used for the locking members 60.

Advantageously, a user can selectively operate the cleaning device 10 to deploy the sponge 40 or scrubbing elements, as best suited for cleaning the cleaning surface 100. In the illustrated embodiment, the user can move (e.g., push) the operating member 32 of the actuator 30 to move the sponge 40 forward relative to the rollers 26 into a deployed cleaning position proximal the cleaning surface 100, as shown in FIG. 3. The sponge 40 can then be used generally as a mop to soak up liquids. When the sponge 40 is in the deployed cleaning position, the brushes 50 and scraper 54 are in a first or retracted position and oriented away from the cleaning surface 100 (see FIG. 3).

The user can alternatively move (e.g., pull) the operating member 32 of the actuator 30 to move the sponge 40 backward into a retracted position away from the cleaning surface 100, as shown in FIG. 5. As the sponge 40 is retracted between the rollers 26, the sponge 40 frictionally engages the movable surface 26*a* of the rollers 26, causing the movable surface 26*a* to rotate in the direction of retraction (see FIG. 4). In the illustrated embodiment, such rotation of the movable surface 26*a* automatically results in the rotation of the brushes 50 and scraper 54 about 180 degrees so that they are positioned in a second or deployed position proximal the cleaning surface 100. Additionally, the rollers 26 advantageously squeeze the sponge 40 as the sponge 40 is retracted into the slot S of the housing 16, thus wringing the sponge 40 of any liquids. As shown in FIG. 5, when the brushes 50 are in the fully deployed position, the locking members 60 engage the sponge 40 to substantially maintain the rollers 26 in a generally fixed position relative to the sponge 40 and to maintain the scrubber brushes 50 in the deployed position. In one embodiment, at least one stop member 70 (see FIG. 1) is disposed on the housing 16 and engages the rollers 26 to limit the rotation of the rollers 26 (and brushes 50) between their first or retracted storage position and their second or deployed cleaning position to about 180 degrees. The stop member 70 can be, for example, a post or protrusion that interacts with the brushes 50. However, the stop member 70 can have other suitable shapes and configurations.

If the user wants to deploy the sponge 40 once again, the user can move the operating member 32 once again, as discussed above, to move the sponge 40 forward. The sponge 40 frictionally engages the movable surface 26*a* of the rollers 26, causing the movable surface 26*a* to automatically rotate in the direction of deployment, which results in the withdrawal of the brushes 50 and scraper 54 into the first or retracted position, as shown in FIG. 3.

In another embodiment (not shown), the operating rod 28 connects to the rollers 26. In this embodiment, the actuator 30 is actuated via the operating member 32 to move the rollers 26 over the sponge 40. The rollers 26 preferably rotate as they move over the sponge 40, for example due to the frictional engagement between the sponge 40 and the rollers 26, to move the brushes 50 from the first or retracted storage position to the second or deployed cleaning position. Additionally, as the rollers 26 rotate over the sponge 40, the rollers 26 advantageously squeeze the sponge 40 so as to wring any liquid out of the sponge 40. When the rollers 26 are in the retracted storage position, the sponge 40 is preferably in the deployed position. Conversely, when the rollers 26 are in the deployed cleaning position, the sponge 40 is preferably in the retracted position between the rollers 26.

Figure 7:
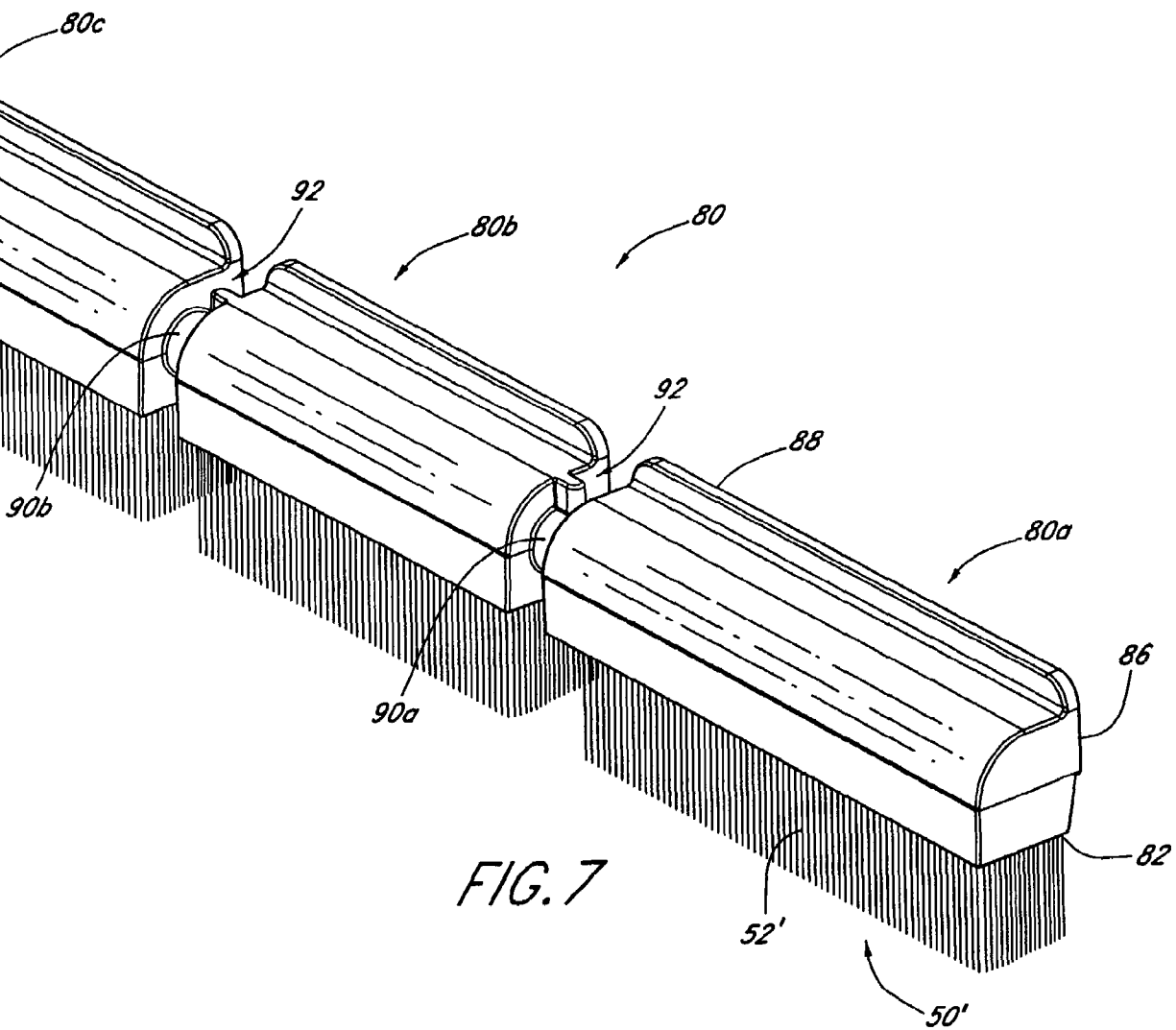
FIG. 7 is a schematic view of one embodiment of a roller assembly for use with the cleaning device of FIG. 6.
Figure 8:
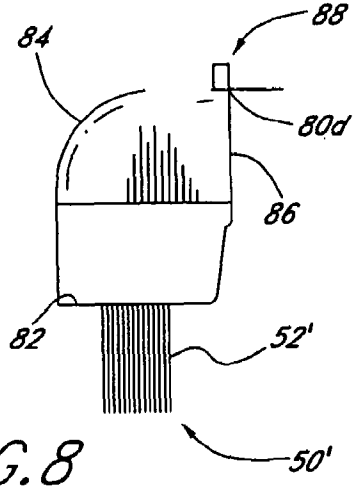
FIG. 8 is a schematic end view of the roller assembly of FIG. 7.

FIGS. 6-8 illustrate another embodiment of a cleaning device 10'. The cleaning device 10' is similar to the cleaning device 10 described above in connection with FIGS. 1-5, except as noted below. Thus, the reference numerals used to designate components of the cleaning device 10' are identical to those used for identifying the corresponding components of the cleaning device 10 in FIGS. 1-5, except that a "'" has been added to the reference numerals.

In the illustrated embodiment, the cleaning device 10' is a mop. The mop 10' can include a roller assembly 80, as best shown in FIGS. 7 and 8. One of ordinary skill in the art will recognize that two roller assemblies 80 would be provided on opposite sides of a sponge 40'. For simplicity, the description below will be with respect to one of the roller assemblies 80, but is applicable to both assemblies of the mop 10'. The roller assembly 80 has first roller 80*a*, a second roller 80*b* and a third roller 80*c*, with the first and second rollers 80*a*, 80*b* and the second and third rollers 80*b*, 80*c* coupled via connectors 90*a*, 90*b*, respectively. However, the roller assembly 80 can have a larger or smaller number of rollers. In the illustrated embodiment, the connectors 90*a*, 90*b* have a circular cross-section. In one embodiment, the connectors 90*a*, 90*b* can be shaft sections that extend partially through the rollers 80*a*, 80*b*, 80*c* of the roller assembly 80. In another embodiment, the connectors 90*a*, 90*b* can be portions of one shaft that extends through the second roller 80*b* and partially extends through the first and third rollers 80*a*, 80*c*. In still another embodiment, the rollers 80*a*-80*c* and the connectors 90*a*, 90*b* can be formed as one piece, such as, for example, via injection molding. The roller assembly 80 can be made of a hard plastic, such as polypropylene. However, other suitable plastics or other materials can be used.

The roller assembly 80 can be fastened to the distal end of the housing 16' via the connectors 90*a*, 90*b*. In one embodiment, the roller assembly 80 is removably fastened to the housing 16' so as to be readily and easily replaceable with another roller assembly 80. For example, the connectors 90*a*, 90*b* of the roller assembly 80 can be removably clamped to the housing 16' (e.g., via a C-shaped clamp (not shown) on the housing). However, other suitable fasteners can be used to fasten the roller assembly 80 to the housing 16', such as via a bracket (not shown) removably fastened to the housing 16' (e.g., with bolts, screws, adhesives, or press-fit connection) and supporting the connectors 90*a*, 90*b* therebetween.

Each of the rollers 80*a*, 80*b*, 80*c* of the roller assembly 80 has generally the same shape. Accordingly, the following description is provided for the configuration one roller, but is applicable to the three rollers 80*a*-80*c* of the roller assembly. The roller assembly 80 has a first surface 82 with at least on scrubbing element disposed thereon. In the illustrated embodiment, the scrubbing element is a scrubber brush 50', wherein the brush 50' has a plurality of bristles 52'. In the illustrated embodiments, a plurality of the scrubber brushes 50' are disposed along substantially the entire length of each roller 80*a*-80*c*. In another embodiment, the brushes 50' can be disposed along one or two of the rollers 80*a*-80*c* (e.g., only on the first and third rollers 80*a*, 80*c*).

Each roller 80*a*-80*c* can have a second surface 84 and a third surface 86 that extend on opposite sides of the first surface 82 and intersect with each other at a junction 80*d*. In the illustrated embodiment, the second surface 84 is generally curved and the third surface is generally straight. However, the second and third surfaces 84, 86 can have other configurations. Each roller 80*a*-80*c* can also have an arm that extends above the junction 80*d* between the second and third surfaces 84, 86 and is generally aligned with the third surface 86. By way of example and not limitation, the arm is shown as a ridge 88 n FIGS. 7-11. The ridge 88 can extend continuously along substantially the entire length of each of the rollers 80*a*-80*c*. In another embodiment, the ridge 88 can extend intermittently along the length of each of the rollers 80*a*-80*c*. In still another embodiment, the ridge 88 can extend along the length of one or two of the rollers 80*a*-80*c*.

The roller assembly 80 also preferably includes a stop member 92, as best shown in FIG. 7. In the illustrated embodiment, the roller assembly 80 has two stop members 92, one on each side of the second roller 80*b*. The stop members 92 preferably engage the housing 16' as the roller assembly 80 is rotated (described in more detail below) to limit the range of rotation of the roller assembly 80 to about 180 degrees. However, stop members 92 can be arranged on the roller assembly 80 so as to provide a rotation range of more or less than 180 degrees.

Figure 9:
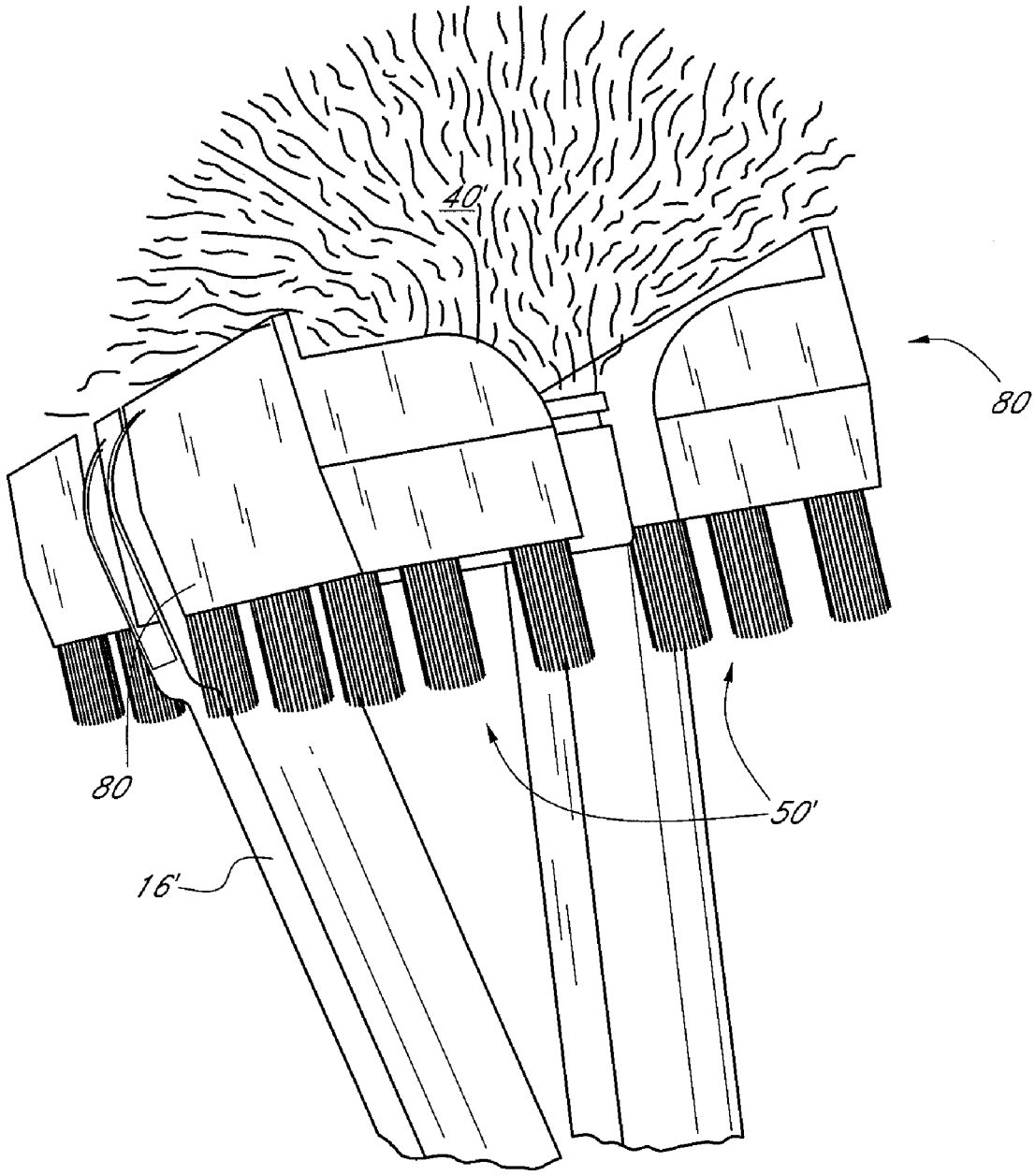
FIG. 9 is a schematic partial perspective view of the cleaning device embodiment in FIG. 6 in a first operating position.
Figure 10:
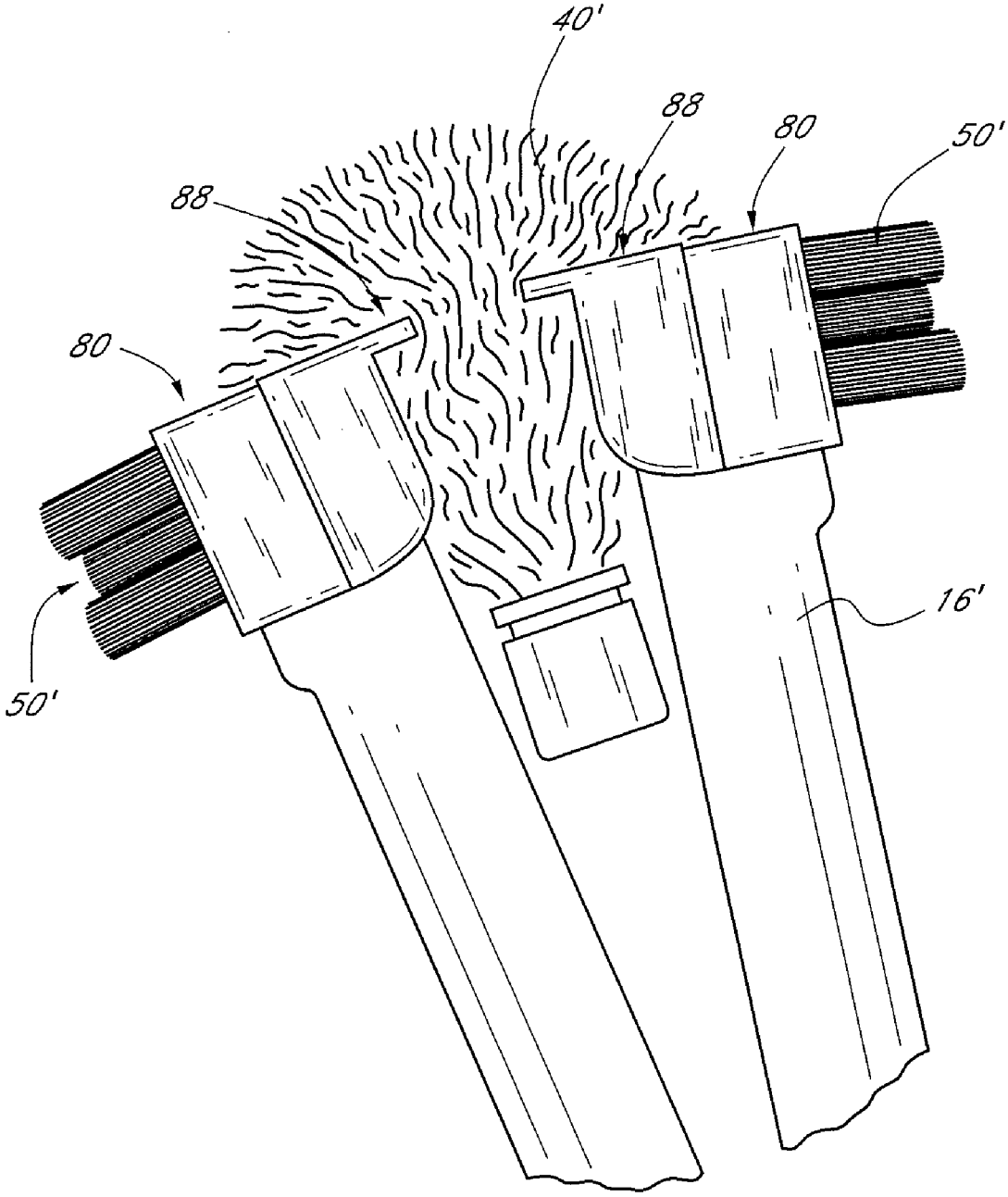
FIG. 10 is a schematic partial perspective view of the cleaning device shown in FIG. 6, in a second operating position.
Figure 11:
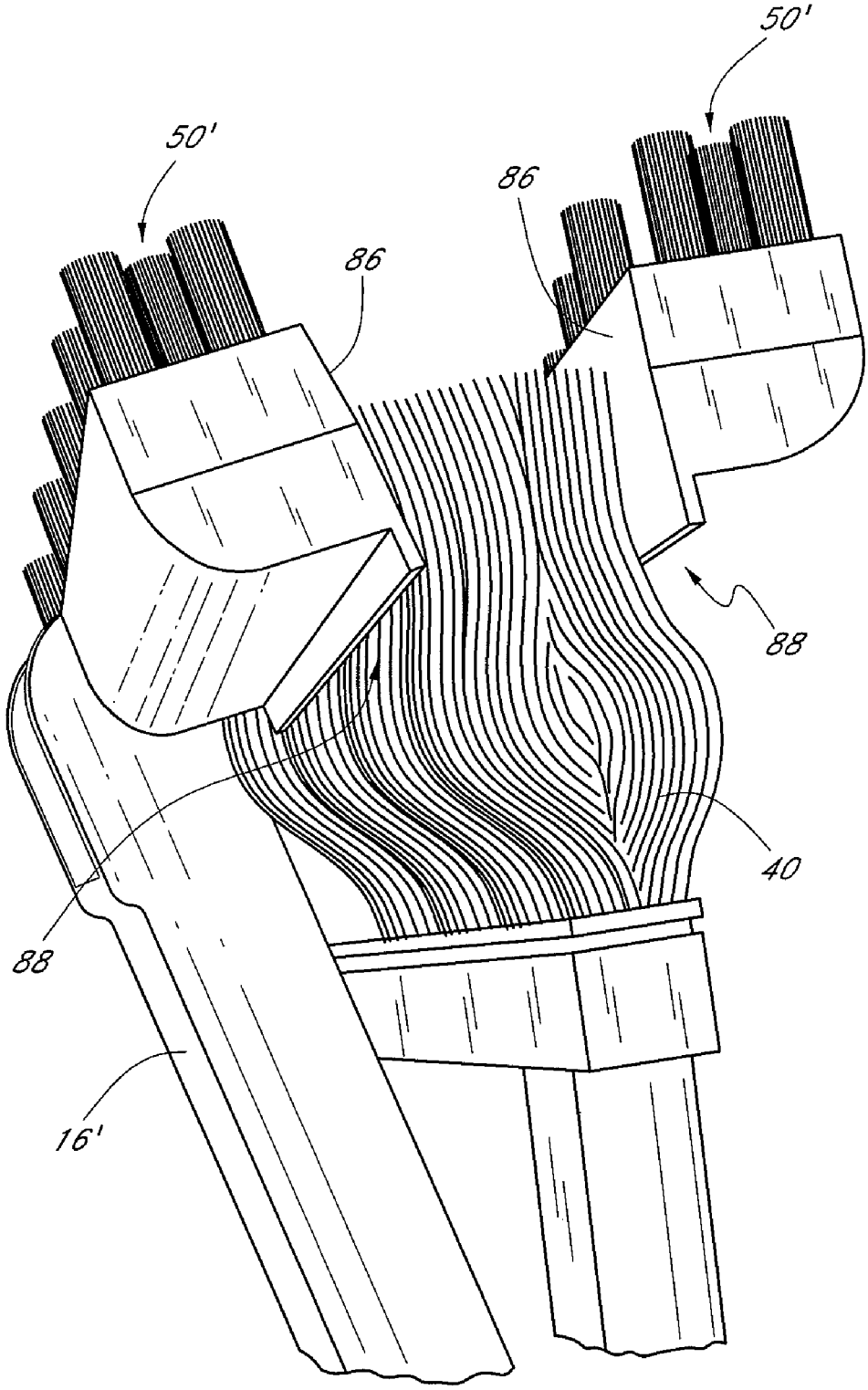
FIG. 11 is a schematic partial perspective view of the cleaning device shown in FIG. 6, in a third operating position.

As discussed above, the rollers 80*a*-80*c* of the roller assembly 80 are preferably rotatably coupled to the housing 16' and have at least one scrubbing element disposed thereon. As illustrated in FIGS. 9-11, a user can selectively operate the cleaning device 10' to deploy the sponge 40', as best suited for cleaning a cleaning surface 100'. The user can move (e.g., push) an operating member 32' of an actuator 30' of the mop 10' to move the sponge 40' forward, relative to the roller assembly 80, into a deployed cleaning position proximal the cleaning surface 100', as shown in FIG. 9. The sponge 40' can then be used generally as a mop to soak up liquids. When the sponge 40' is in the deployed cleaning position, the brushes 50' are in a first or retracted position and oriented generally away from the cleaning surface 100' (see FIG. 9).

The user can alternatively move (e.g., pull) the operating member 32' of the actuator 30' to retract the sponge 40' into the housing 16' and away from the cleaning surface 100', as shown in FIG. 10. As the sponge 40' is retracted between the roller assemblies 80 on both sides of the sponge 40', the sponge 40 ' frictionally engages the second surface 84 of the rollers 80*a*-80*c*, causing the rollers 80*a*-80*c* to rotate in the direction of retraction (see FIG. 10). As the rollers 80*a*-80*c* rotates, the sponge 40' is squeezed between the ridges 88 of each roller 80*a*-80*c*, so as to wring the sponge of any liquid. Additionally, the rotation of the rollers 80*a*-80*c* rotates the brushes 50' about 180 degrees so that they are positioned in a second or deployed scrubbing position proximal the cleaning surface 100' (see FIG. 11). Additionally, in the deployed scrubbing position the sponge 40' is squeezed between the third surfaces 86 of the rollers 80*a*-80*c* on opposite sides of the sponge 40' as the sponge 40' is retracted into a slot S' of the housing 16', thus wringing the sponge 40' of liquids. As shown in FIG. 11, when the brushes 50' are in the fully deployed scrubbing position, the ridges 88 and third surfaces 86 of the rollers 80*a*-80*c* engage the sponge 40' to substantially maintain the rollers 80*a*-80*c* in a generally fixed position relative to the sponge 40' and to maintain the scrubber brushes 50' in the deployed position. The stop members 92 limit the rotation of the roller assembly 80 (and brushes 50') between the first or retracted storage position and the second or deployed scrubbing position. As described above, the range of rotation allowed by the stop member 92 can be about 180 degrees, or can be lower or greater than 180 degrees.

If the user wants to deploy the sponge 40' once again, the user can move the operating member 32' once again, as discussed above, to move the sponge 40' forward. As the sponge 40' moves forward, it frictionally engages the third surface 86 of each of the rollers 80*a*-80*c*, causing the rollers 80*a*-80*c* to automatically rotate in the direction of deployment of the sponge 40', which results in the withdrawal of the brushes 50' into the first or retracted position, as shown in FIG. 9.

The various devices, methods and techniques described above provide a number of ways to carry out the invention. Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A combination sponge mop and scrubber for cleaning a surface, comprising:

a housing;

a pair of rollers mounted on the housing with a roller disposed on each side of a sponge, at least one of the rollers supporting a scrubber brush, the rollers configured to squeeze the sponge when the sponge is retracted into the housing, the rollers automatically rotated via a frictional engagement with the sponge to move the scrubber brush into a deployed position to scrub the cleaning surface as the sponge is retracted, a generally flat surface of at least one of the rollers engages the sponge while the scrubber brush is in the deployed position so as to maintain the scrubber brush in a substantially fixed position, and at least one stop member attached to at least one of the rollers, the stop member configured to engage the housing when the sponge is retracted between the rollers and the scrubber brush is in the deployed position, so as to limit the rotation of the rollers, wherein said scrubber brush is automatically deployed whenever the sponge is squeezed to discharge liquid therefrom.

2. The sponge mop and scrubber of claim 1, wherein the at least one stop member limits the rotation of the rollers to about 180 degrees.

3. The A combination sponge mop and scrubber for cleaning a surface, comprising:

a housing;

a pair of rollers mounted on the housing with a roller disposed on each side of a sponge, at least one of the rollers supporting a scrubber brush, the rollers configured to squeeze the sponge when the sponge is retracted into the housing, the rollers automatically rotated via a frictional engagement with the sponge to move the scrubber brush into a deployed position to scrub the cleaning surface as the sponge is retracted at least one of the rollers has an arm that is translated inward toward the housing and above rotating axes of the rollers when the sponge is retracted within the housing to bias the scrubber brush in the deployed position; and at least one stop member attached to at least one of the rollers, the stop member configured to engage the housing when the sponge is retracted between the rollers and the scrubber brush is in the deployed position, so as to limit the rotation of the rollers, wherein said scrubber brush is automatically deployed whenever the sponge is squeezed to discharge liquid therefrom.

4. A mop for cleaning a surface, comprising:

a shaft;

a housing disposed at a distal end of the shaft;

a sponge movably coupled to the housing;

a pair of rollers movably mounted to the housing, the rollers spaced apart from one another and straddling at least a portion of the sponge, at least one of the rollers having an arm translatable over rotating axes of the rollers and under the rotating axes of the rollers;

an actuator configured to move the sponge into a retracted position between the rollers, wherein the rollers squeeze the sponge to wring liquid from the sponge; and at least one scrubbing element disposed on at least one of the rollers, the at least one scrubbing element configured to automatically move into a deployed position as the sponge is retracted, the at least one scrubbing element configured to automatically move into a retracted position when the sponge is moved into a deployed position;

a stop member disposed on at least one of the rollers, the stop member configured to engage the housing when the at least one scrubbing element is in the deployed position, the stop member urged against the housing when the arm is translated over the rotating axes of the rollers by the sponge to maintain the at least one roller in a generally fixed position relative to the housing;

wherein the sponge pushes against the arm when the arm is translated over the rotating axes to maintain the scrubbing element in the deployed position.

5. A mop of claim 4, wherein the at least one scrubbing element comprises a brush.

6. The mop of claim 4, wherein the stop member is disposed generally about 180 degrees from the at least one scrubbing element.

7. The device of claim 4, wherein the stop member is configured to limit the rotation of the rollers to about 180 degrees.

8. A combination sponge mop and scrubber brush wherein said scrubber brush is automatically deployed whenever the sponge is squeezed to discharge liquid therefrom comprising:

a housing;

a pair of rollers mounted on the housing with a roller disposed on each side of a sponge, the rollers defining rotating axes, at least one of the rollers supporting a scrubber brush, the rollers configured to squeeze the sponge when the sponge is retracted into the housing, the rollers automatically rotating to move the scrubber brush into a deployed position as the sponge is moved into a retracted position; and an arm translatable above the rotating axes when the sponge is retracted into the housing to bias the scrubber brush into the deployed position, the arm translatable below the rotating axes when the sponge is extended out of the housing wherein the arm is in contact with the sponge when the sponge is retracted within the housing to bias the scrubber brush toward the deployed position;

a stop member attached to the roller, the stop member engaging the housing when the sponge contacts and presses against the arm to limit rotation of the roller and maintain the scrubber brush in the deployed position.

9. A combination sponge mop and scrubber brush wherein said scrubber brush is automatically deployed whenever the sponge is squeezed to discharge liquid therefrom comprising:

a housing;

a pair of rollers mounted on the housing with a roller disposed on each side of a sponge, the rollers defining rotating axes, at least one of the rollers supporting a scrubber brush, the rollers configured to squeeze the sponge when the sponge is retracted into the housing, the rollers automatically rotating to move the scrubber brush into a deployed position as the sponge is moved into a retracted position; and an arm translatable above the rotating axes when the sponge is retracted into the housing to bias the scrubber brush into the deployed position, the arm translatable below the rotating axes when the sponge is extended out of the housing;

wherein the roller has a generally curved portion for squeezing liquid out of the sponge and a scrubber brush portion, the scrubber brush attached to the scrubber brush portion for abrasively cleaning a cleaning surface, the generally curved portion extending from a side of the scrubber brush portion, the arm disposed outside of the generally curved portion such that the sponge pushes against the arm to maintain the scrubber brush in the deployed position.

10. The combination sponge mop and scrubber brush of claim 9, wherein the arm and roller defines a generally flat engagement surface in contact with the sponge when the sponge is retracted within the housing to bias the scrubber brush in the deployed position.

* * * * *